US012038209B2

(12) United States Patent
Dogruer

(10) Patent No.: US 12,038,209 B2
(45) Date of Patent: Jul. 16, 2024

(54) SYSTEM AND CONTROL METHOD FOR A SELF-CONTAINED MARINE AIR CONDITIONER UNIT

(71) Applicant: Archer Power Solutions Inc., Beltsville, MD (US)

(72) Inventor: Onat Dogruer, Beltsville, MD (US)

(73) Assignee: Archer Power Solutions Inc., Beltsville, MD (US)

( * ) Notice: Subject to any disclaimer, the term of this patent is extended or adjusted under 35 U.S.C. 154(b) by 0 days.

(21) Appl. No.: 18/375,549

(22) Filed: Oct. 1, 2023

(65) Prior Publication Data

US 2024/0110737 A1 Apr. 4, 2024

Related U.S. Application Data

(60) Provisional application No. 63/378,023, filed on Sep. 30, 2022.

(51) Int. Cl.
*F25B 41/31* (2021.01)
*F25B 13/00* (2006.01)

(52) U.S. Cl.
CPC ..... *F25B 41/31* (2021.01); *F25B 13/00* (2013.01)

(58) Field of Classification Search
CPC ..... F25B 13/00; F25B 41/31
See application file for complete search history.

(56) References Cited

U.S. PATENT DOCUMENTS

| | | | | |
|---|---|---|---|---|
| 5,417,075 | A * | 5/1995 | Manz | F25B 45/00 62/85 |
| 5,848,536 | A | 12/1998 | Dodge et al. | |
| 6,263,689 | B1 | 7/2001 | Dodge et al. | |
| 11,454,436 | B2 * | 9/2022 | Park | F25B 49/022 |
| 2006/0179871 | A1 | 8/2006 | Wagner | |
| 2007/0261423 | A1 | 11/2007 | Vanderee et al. | |
| 2013/0091883 | A1 * | 4/2013 | Perez | F04B 49/20 62/238.7 |
| 2022/0126973 | A1 * | 4/2022 | Ripoll | F25B 13/00 |
| 2023/0048412 | A1 | 2/2023 | Liptak et al. | |

FOREIGN PATENT DOCUMENTS

| | | |
|---|---|---|
| AU | 2006202056 | 5/2006 |
| CN | 208393610 | 1/2019 |
| WO | WO2012001630 | 1/2012 |
| WO | WO2022162534 | 8/2022 |

* cited by examiner

*Primary Examiner* — Miguel A Diaz
(74) *Attorney, Agent, or Firm* — DOSTER GREENE, LLC

(57) ABSTRACT

A marine air conditioning unit, according to various embodiments, can include a base plate having one or more mounting holes. A main unit is supported on the base plate comprising an evaporator, a compressor, a compressor driver, a condenser, an electronic expansion valve, a blower, an electrical pressure sensor and a condensation pan operatively coupled together. The compressor can be a variable speed inverter brushless direct current (BLDC) compressor. The electronic expansion valve can be located in a refrigerant line connecting the condenser to the evaporator. A controller can constantly receive and, using an algorithm, analyze sensor information from multiple sensors positioned within the main unit. Based on the sensor information, the controller can transmit a control signal to various components and further adjust the electronic expansion valve to control the precise amount of refrigerant to pass to the evaporator.

18 Claims, 6 Drawing Sheets

SYSTEM AND CONTROL METHOD FOR A SELF-CONTAINED MARINE AIR CONDITIONER UNIT

I. TECHNICAL FIELD

The present disclosure relates generally to the field of marine air conditioners, and more particularly to a system and method for monitoring and controlling a self-contained marine air conditioner unit.

II. BACKGROUND

Marine air conditioners are used to remove the heat from the inside of a cabin of a boat to increase the passengers' comfort, such as when the boat is stationary during anchoring or staying at the dock or during inclement weather like when it's raining. However, the limiting factor with boats is the power needed for conventional air conditioners. Electricity generation and storage are paramount, unless the boat is a large vessel with enough room to also carry a dedicated power plant. The essential considerations for choosing an air conditioner include the amount of space needed to be cool, the room available for an air conditioner unit, and the ease of setup.

There are various types of marine air conditioners on the market. The most common air conditioner on a boat is the self-contained, direct-expansion system designed to work with industry standard 110V/220V Alternating Current (AC). A typical boat has three sources of power—a 110V (or 220V) AC which is supplied by a shore connection (by connecting a heavy-duty cord to the inlet of the vessel) or onboard diesel or gasoline generators and/or 12-48 VDC battery bank (which is charged by solar/wind or shore power AC-DC chargers). The 110V/220V marine air conditioners are readily available in the marketplace. These air conditioners typically run off a generator or off shore power when the boat is tied up to the dock. However, when the vessel is at anchor, unless the boat is equipped with an alternating current (VAC) generator, these air conditioners are unusable. The challenge has been to be able to enjoy the boat at anchor, during cruising and still have air conditioning. Some users adapted low-cost gasoline powered inverter generators (which are extremely dangerous as a fire and carbon monoxide hazards) to start lower BTU rated VAC air conditioners. However, a typical VAC air conditioner has significant starting power needs (amp spike at start up). In most conventional air conditioners, the high power draw needed is the result of the compressor type and the amount of power it needs to remove the heat from the intended space.

There is a need for an energy efficient marine air conditioner that integrates newer, advanced technologies and eliminates all the hassle and expenses associated with these conventional devices and provides the comfort of continuous use of an air conditioner when the boat is stationary, during cruising and during inclement weather. There is a further need to improve the passengers' comfort by not only controlling the temperature, but also by monitoring and controlling the humidity level within the cabin.

III. SUMMARY

The embodiments featured herein help solve or mitigate the above noted deficiencies as well as other issues known in the art. Other features and/or advantages may become apparent from the description which follows.

A marine air conditioning unit according to various exemplary embodiments can include a base plate, a main unit and a controller. The base plate can include one or more mounting holes. The main unit, which is supported on the base plate, can include an evaporator, a compressor, a compressor driver, a condenser, an electronic expansion valve, a blower, a water pump, and a condensation pan operatively coupled together. The blower can draw indoor air from a room of a boat through the evaporator. The compressor can be located in a refrigerant line connecting the condenser to the evaporator to compress refrigerant flowing therethrough. The electronic expansion valve can be located in the refrigerant line and configured to operate as a flow regulator to create a pressure difference between the condenser and the evaporator. The water pump can circulate water into the condenser to absorb heat from the refrigerant. The water can be drawn from a body of water in which the boat is floating. The controller can constantly receive and, using an algorithm, analyze sensor information from multiple sensors positioned within the main unit. Based on the sensor information, the controller can determine an amount of refrigerant to pass to the evaporator, and the controller can transmit a control signal to adjust the electronic expansion valve to control a precise amount of refrigerant to pass to the evaporator.

According to an embodiment, the marine air conditioning unit cools and dehumidifies a boat. The unit is a self-contained marine air conditioner system, which is composed of 3 sections: a self-contained air conditioner, a control box, and a user interface screen. The unit is designed for use as a cabin cooler on boats larger than 35 feet. For smaller vessels, the unit can serve to cool an entire living compartment. It is a self-contained unit such that all components are integrated and attached to a main unit. The unit is designed for use in rugged, salt-water environments.

The unit takes advantage of modern variable speed compressors so the current draw in average is less than half compared to the typical 29 A to 40 A-equivalent draws; allowing extended use by boats' existing battery banks. The unit is designed specifically to be used overnight (or an extended period of time) at anchor without the need to use a generator, an inverter, or other AC (alternating current) generating devices. The unit is extremely quiet in comparison to loud window units, and avoids the noise of a generator.

The unit is designed especially for ease of installation, operation and maintenance; most components being replaceable by the user.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art based on the teachings provided.

BRIEF DESCRIPTION OF THE DRAWINGS

Illustrative embodiments may take form in various components and arrangements of components. Illustrative embodiments are shown in the accompanying drawings, throughout which reference numerals may indicate corresponding or similar parts in the various drawings. The drawings are only for the purpose of illustrating the embodiments and are not to be construed as limiting the disclosure. Given the following enabling description of the drawings, the novel aspects of the present disclosure should become evident to a person of ordinary skill in the relevant art.

IV. DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

According to the present disclosure, various embodiments discloses a unit, which is a self-contained marine air conditioner system, that is composed of 3 sections: a self-contained air conditioner unit 100, a control box 200, and a user interface unit 300.

Figure 1:
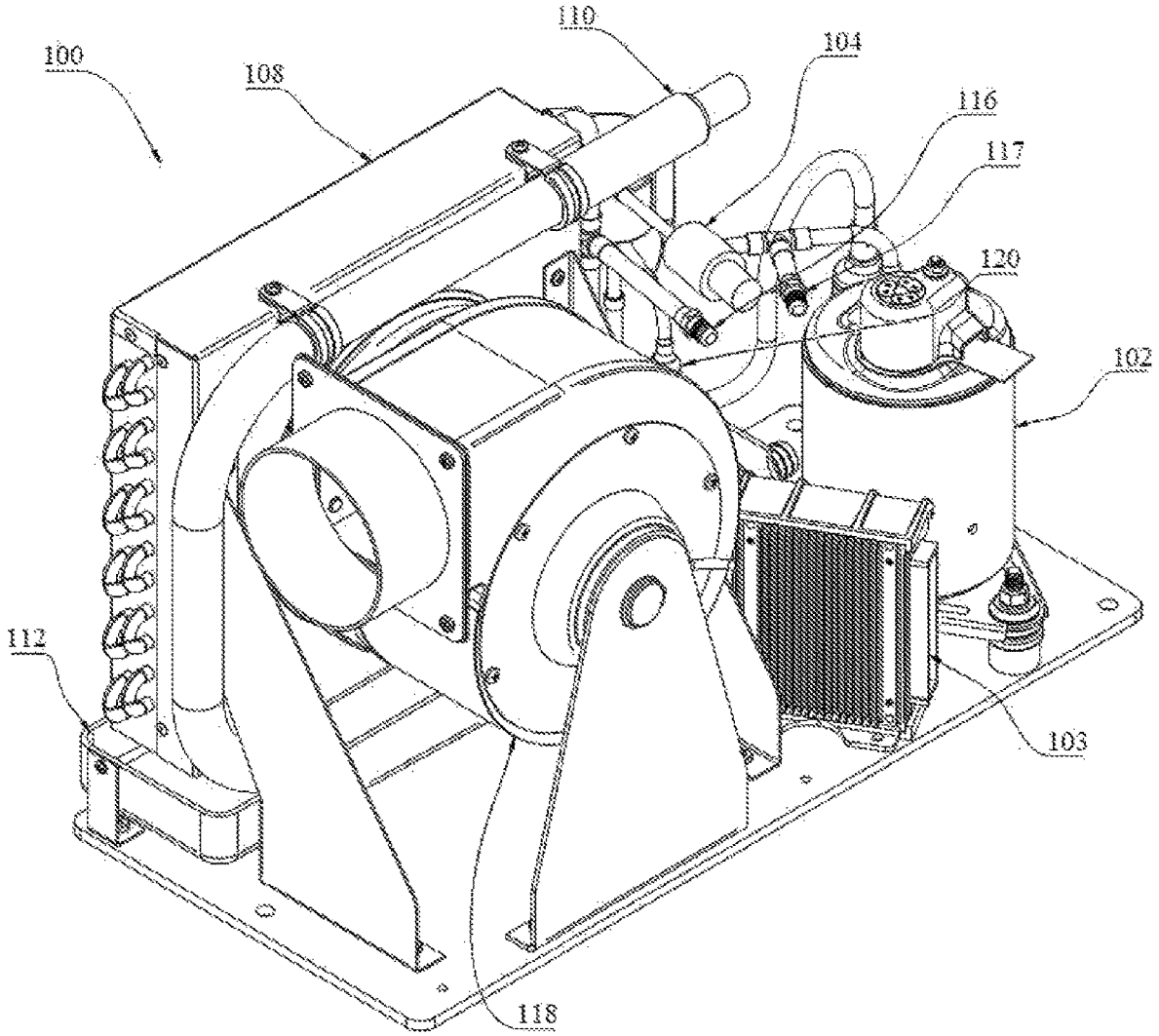
FIG. 1 depicts a front perspective view of an exemplary self-contained marine air conditioner unit in accordance with one or more embodiments of the disclosure.
Figure 2:
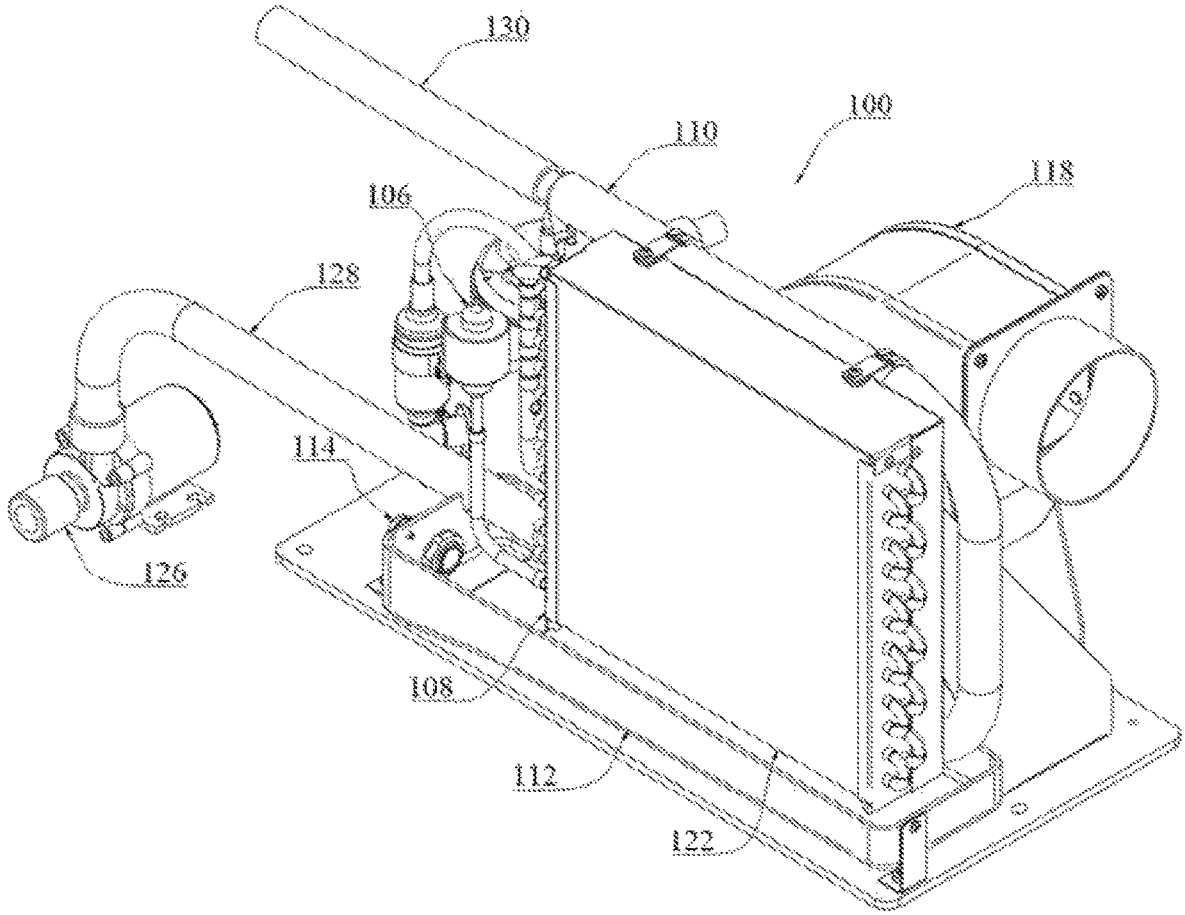
FIG. 2 depicts a rear perspective view of the self-contained marine air conditioner unit of FIG. 1 in accordance with one or more embodiments of the disclosure.
Figure 3:
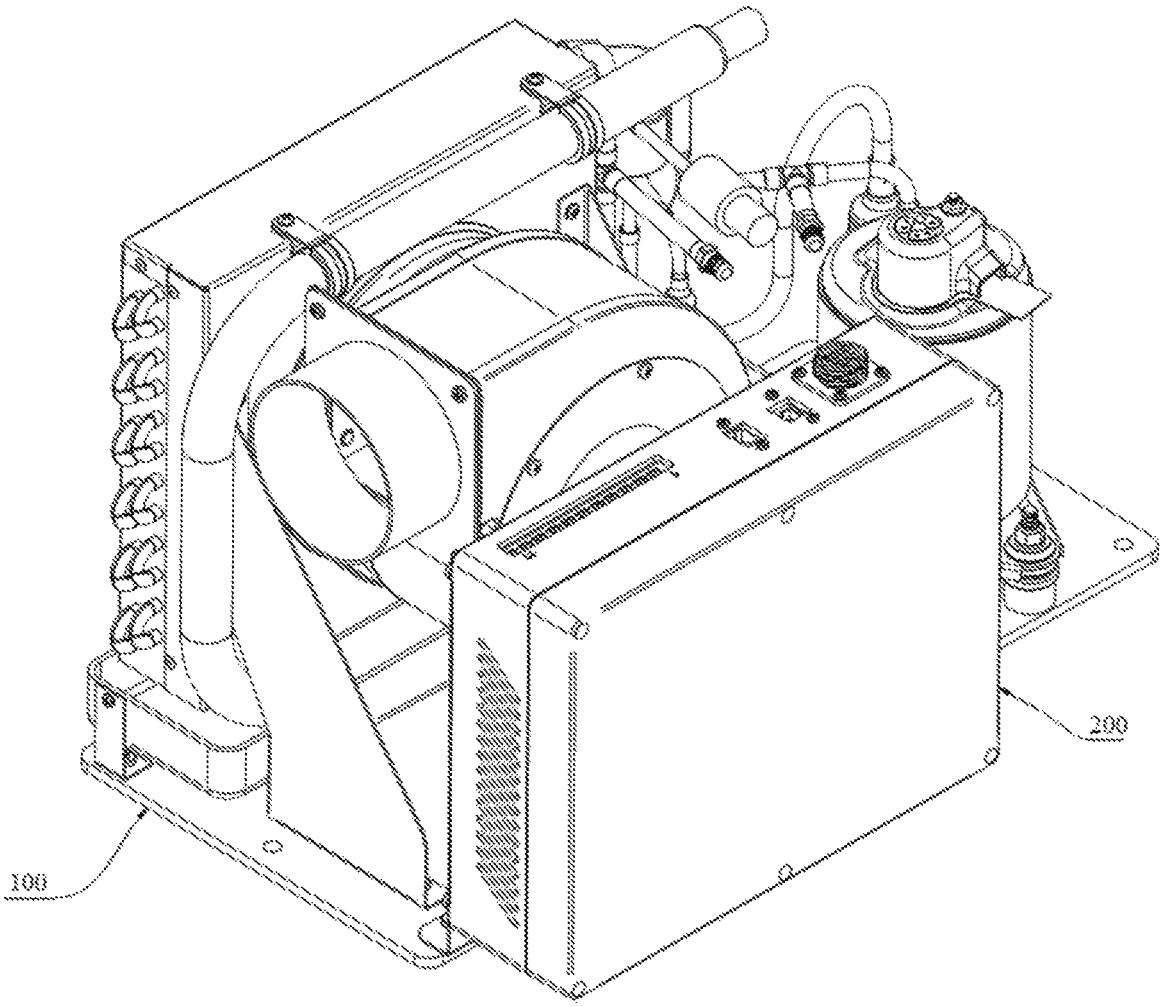
FIG. 3 depicts a front perspective view of the self-contained marine air conditioner unit with a control box attached in accordance with one or more embodiments of the disclosure.

As shown in FIGS. 1-3, the main unit, which is the air conditioner 100, houses a variable speed BLDC compressor 102 along with a compressor driver 103, an electrical pressure sensor 104, an electronic expansion valve (EEV) 106, an evaporator 108, a condenser 110, a blower fan 118, and a condensation pan 112. The layout of the basic components may be similar to conventional designs.

Components of the air conditioner unit 100 are connected via copper pipes to ensure refrigerant pressure stability, long-lasting performance and to reduce corrosion against salt water. The major components of the air conditioner unit 100 are mounted on a base plate 124. The air conditioner 100 is mounted to a surface of a boat using fasteners through the holes on the base plate 124. In an exemplary embodiment, the condensation pan 112 is sloped and includes a condensation drain 114 to allow the condensation pan 112 to empty. The system comprises thru-hull connections to draw cooling water into the unit. The system uses, preferably, seawater as cooling water or the water of the body of water in which the boat is floating.

The blower fan 118 is mounted in communication with the evaporator 108, wherein the blower pulls warm cabin air through the evaporator 108. The blower fan 118 orientation is adjustable, allowing for optimal positioning of the cold air exit port. The blower fan 118 pushes the cold air back into the area to be cooled. The evaporator 108 is where refrigerant absorbs heat from the cabin air. A pressure sensor 104 is connected on the refrigerant return line to the compressor 102 such that the pressure sensor 104 measure the pressure on the low pressure line. Two service valves 116 and 117 are available for the unit to be serviced when needed. The service valve 116 may be on the low pressure side, and the service valve 117 may be on the high pressure side. The compressor 102 increases the pressure of the refrigerant throughout the system and pushes the refrigerant to absorb more heat from the air in the environment it needs to cool. In the preferred embodiments, the compressor 102 may be an inverter brushless direct current (BLDC) compressor having variable flow performance characteristics. In addition to heating and cooling, a heat exchanger can also be used as the condenser 110 in which the fluids is condensed from a vapor into a liquid state via heat exchange. As such, the condenser 110 is used to cool the refrigerant and liquefy it before being pumped back into the evaporator 108.

In contrast to all other comparable conventional BTU rated units in the marketplace that use capillary tubes as a mechanical valve, thermostatic expansion valve (TXV) or simple electrical expansion valves, the marine air conditioner of the present disclosure uses an electronic expansion valve (EEV) 106 with a fully adjustable programmable opening. While these conventional valves are purely mechanical, EEV 106 can be programmed to operate with other components in the system, allowing it to further optimize performance and efficiency. The EEV 106 precisely controls the amount of refrigerant that flows into the evaporator 108. As opposed to the conventional valves, the fully adjustable programmable opening of the EEV 106 determines far more accurately how much refrigerant flow to increase or decrease based on the information it receives, within increments of 0.1%.

In the exemplary embodiment shown, the EEV 106 is located in the refrigerant line between the condenser 110 and the inlet of the evaporator 108 to accurately control the flow of the refrigerant into the evaporator 108 in response to signals by an electronic controller 204. A refrigerant filter 120 (or dryer) can be located in the refrigerant line. The EEV 106 operates as a flow regulator that creates a pressure difference between the condenser 110 and the evaporator 108. The evaporator 108 may include an air filter 122. One or more sensors, for example temperature sensors, humidity sensors, and/or pressure sensors, may be located on the condenser, high pressure side or low pressure side after the evaporator 108 to constantly take measurements and send this data to the controller 204. The controller 204 constantly monitors the collected data including the pressure and temperature measurements. Based on the collected data, the controller 204 can be used to open and close the valve port of the EEV 106 on an incremental basis, such as steps, revolutions or steps per revolutions. Based on the signals from the pressure and temperature sensors, the controller 204 sends a signal to instruct the EEV 106 if it should open or close a bit more and by exactly how much. This incremental movement enables ultra-precise control over the flow of the refrigerant.

Based on the measurements, the controller 204 uses an algorithm to determine the proper EEV 106 opening thereby precisely controlling the amount of refrigerant in the evaporator 108. The controller 204 also synchronizes the EEV to the compressor 102 to further lower the power draw. The controller 204 can synchronize the compressor speed with the refrigerant flow rate. The compressor speed can be calculated such that the compressor 102 operates at various compressor speeds. The compressor speed can be controlled by throttling to speed up or slow down the compressor 102, as needed. Thus, the speed of compressor 102 is variable, which is in contrast to conventional compressors that operate either on or off. Traditional compressors operate at a constant speed, continuously switching on and off. Based on the calculated compressor speed, the controller 204 then sends the control signals to adjust the EEV 106 to produce the precise amount of refrigerant into the evaporator 108. The controller 204 constantly controls and/or collects data from the compressor driver 103 and the EEV driver 206 and based on the various temperature and data conditions, the system can calculate hundreds of combinations and/or permutations for adjustment of the EEV 106 within fractions of a second or milliseconds. As a result, the system is able to maintain the precise control of the volume of refrigerant in the evaporator 108. These rapid calculations and continuous monitoring result in a significantly less energy consumption. Thus, according to the system and control method of the present disclosure, by implementing these valve adjustments, a cumulative system power reduction of 33% was estimated to have been achieved. Furthermore, the precise control of refrigerant flow allows for the minimal volume of refrigerant use. The controller 204 and the EEV driver 206 is indifferent to the refrigerant type. Controller 204 and the EEV driver 206 can be adjusted to work with any type of refrigerant commercially available or as needed.

Figure 4:
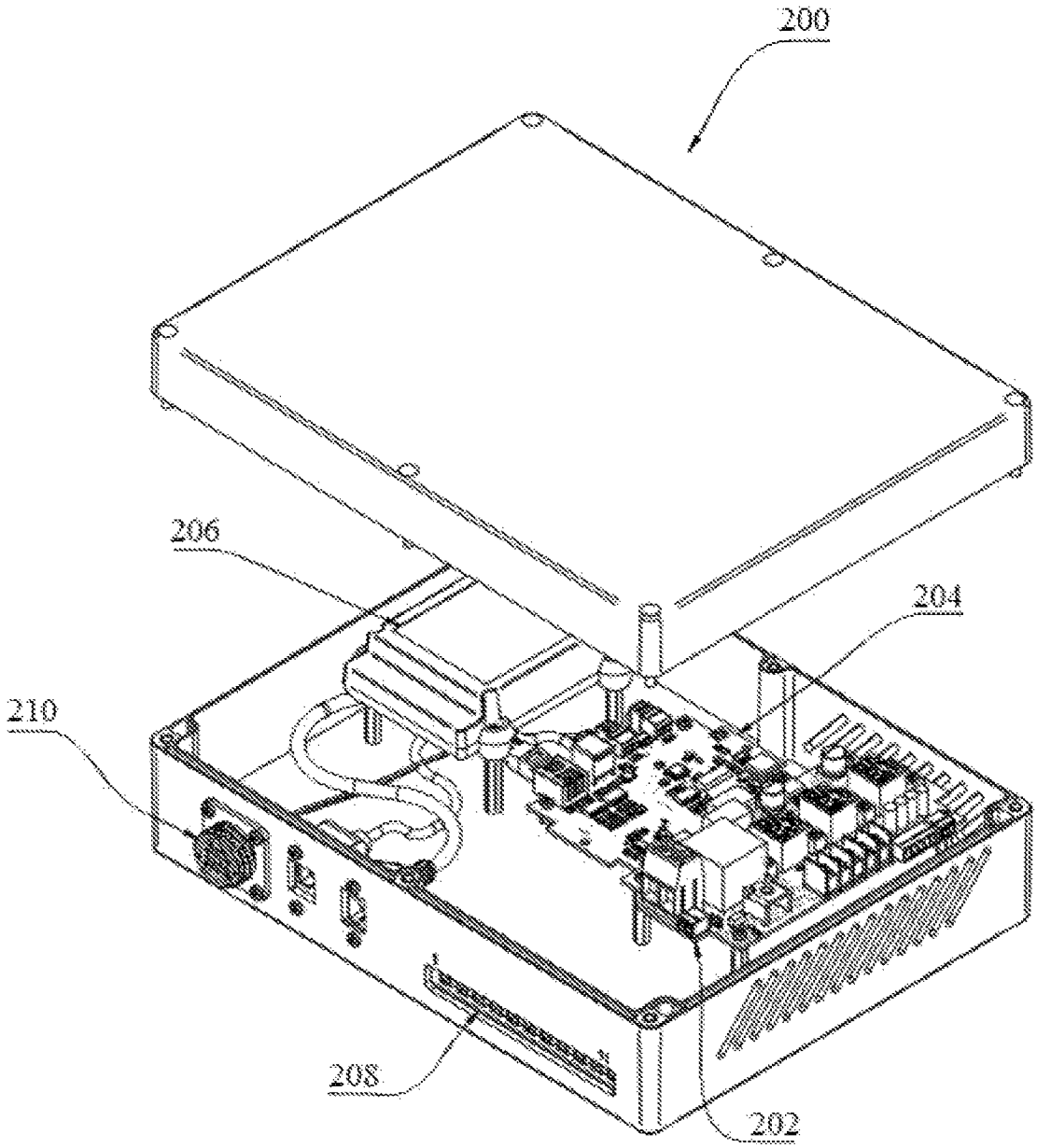
FIG. 4 depicts a partially-exploded front view of the control box of FIG. 3 in accordance with one or more embodiments of the disclosure.

FIG. 4 illustrates the control box 200. The unit is powered and controlled through a specially engineered and designed control box 200. The control box 200 is connected to the air conditioning unit 100 with wire harness terminal 210 to provide power and control. The housing of the control box 200 is embodied as an enclosure that can be mounted on the air conditioner unit base plate 124 or in a user designated location if more convenient. The housing can be attached on the unit or unmounted providing multiple mounting options.

As shown in FIG. 4, the control box 200 comprises the controller 204 communicatively coupled to inputs of various components. The control box 200 may comprise one or more modules, such as a proprietary relay board 202, a proprietary controller 204, and an EEV driver 206. The proprietary relay board 202 can be a PCB board which includes firmware and relays data between the components via the RS 485 protocol. The proprietary control board can be a PCB board which includes firmware and an algorithm that synchronizes the compressor 102 with the electronic expansion valve controller 204 and communicates with relay board 202 via the RS 485 protocol. The algorithm can be applied to data collected from various components, such as evaporator entrance and midpoint temperature sensors, pressure sensors, humidity sensors, seawater temperature sensors, and EEV open ratio 0-100%. The EEV opening can be defined as the ratio of the EEV opening to the full opening. The EEV 106 can be configured to have an EEV open ratio ranging from 0-100%. A full stroke corresponds to 100% opening of the EEV 106 and a completely close state corresponds to 0% opening of the EEV 106. For example, the EEV opening can be adjusted from 40% to 60% of full opening in increments of 0.1%. The EEV driver 206 can be configured to drive the EEV 106 according to the control signals from the controller 204. Various embodiments can include a compressor controller and driver 103.

Wiring harnesses exit 210 passes through openings in the control box 200 and contains an assembly of electrical cables or wires used to transmit electric power, control signals, and the like to various electronic devices mounted in the unit. The control box 200 includes a power terminal 208 for providing an electrical connection to the control box 200.

In alternative arrangements, one or more of the modules may be omitted. Additionally, or alternatively, in some arrangements, two or more of the modules may be combined, e.g., into a single module configured to perform the functions of each module.

In general, in various embodiments, the system may include a processor, a memory, a user interface, a display, one or more sensors, and a communication interface.

The processor may be any means configured to execute various programmed operations or instructions stored in a memory device, such as a device or circuitry operating in accordance with software or otherwise embodied in hardware or a combination of hardware and software (e.g. a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor as described herein. In this regard, the processor may be configured to analyze electrical signals communicated thereto to provide data for operation of an air conditioner unit 100. For example, the processor may be configured to receive data and user input via RS485 communications protocol associated with the data to generate or modify operating conditions of the air conditioner unit 100 for display to a user (e.g., on display 302/user interface unit 300).

In some embodiments, the processor may be further configured to implement signal processing or enhancement features to improve the operating condition of the air conditioner unit 100, collect or process data, such as time, temperature, humidity, or other types of data. It may further implement notices and alarms.

The memory may be configured to store instructions, computer program code, and other data associated with the air conditioner system in a non-transitory computer readable medium for use, such as by the processor.

The communication interface may be configured to enable connection to external systems (e.g., an external network). In this manner, the control box 200 may retrieve stored data from a remote, external server via the external network in addition to or as an alternative to the onboard memory.

Figure 5:
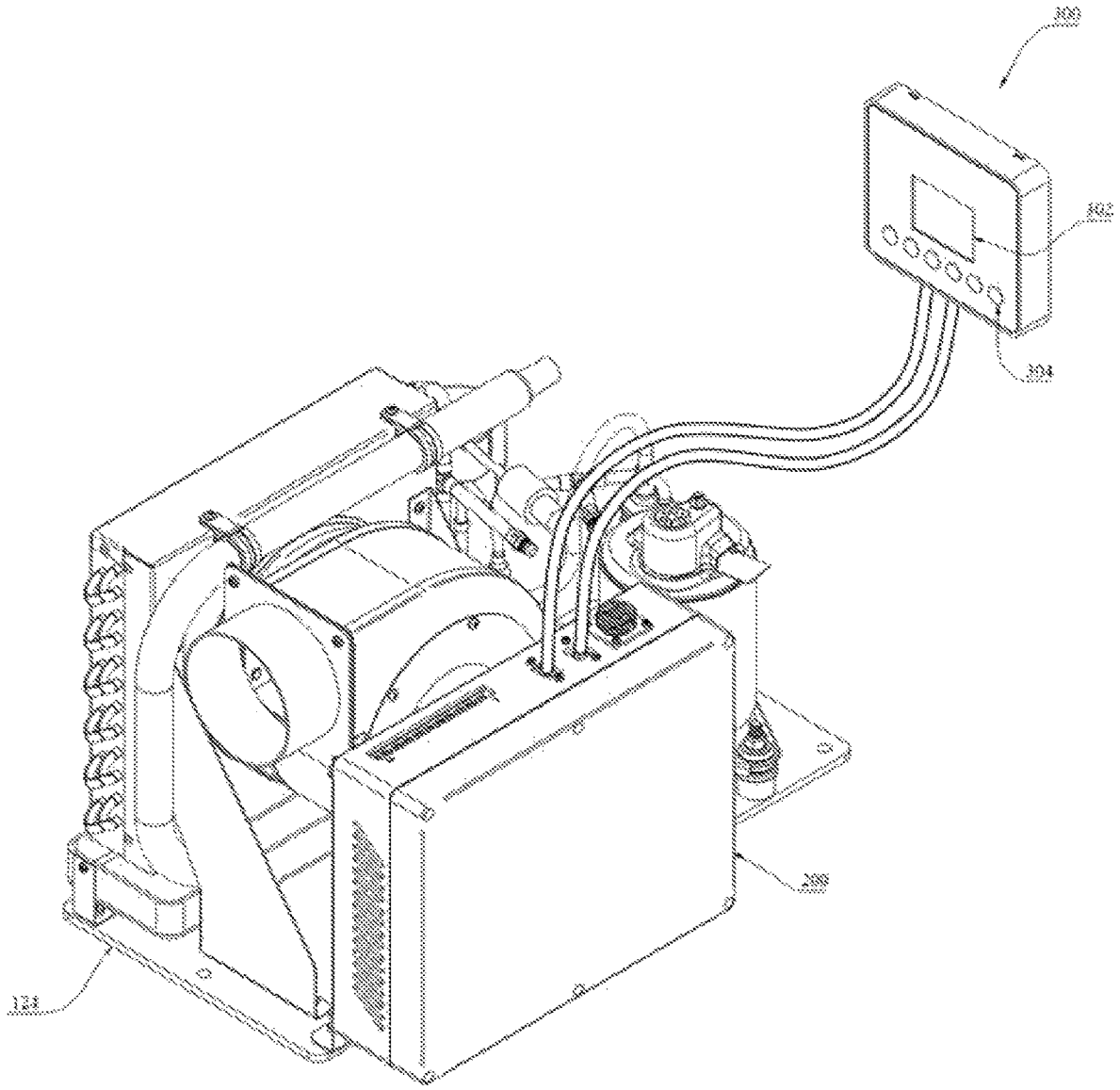
FIG. 5 depicts a perspective front view of a user interface coupled to the control box of FIGS. 3-4 in accordance with one or more embodiments of the disclosure.

The control box 200, which includes the necessary components for controlling the system, also comprises a Programmable Logic Controller (PLC) that is coupled to a proprietary designed user interface unit 300 shown in FIG. 5. The user interface unit 300 can be easily installed anywhere within the cabin via cables or through wireless transmission.

Users interact with the system, in various embodiments, via an interface, such as a touch panel interface, a PDA interface, a PC interface, and a TV interface. The display 302 may be configured to display data and/or images and may include or otherwise be in communication with the user interface unit 300 configured to receive an input from a user. User interface unit 300 may be configured to facilitate user interaction with air conditioner unit 100 and/or to provide feedback to a user. In an embodiment, a user may interact with the user interface unit 300 to place the air conditioner unit 100 into various modes of operation, to initiate certain functions, to modify settings, set options, etc. In addition, the present invention enables communication between Internet of Things (IOT) devices that are capable of communicating using numerous wireless protocols, including WiFi, Bluetooth, ZigBee, and more.

The user interface unit 300 housing includes sensors, a proprietary communication PCB, a screen and touch buttons 304. The user interface unit 300 not only controls the temperature, but it also monitors the humidity level. The applicant is not aware of any current marine air conditioner on the market that is designed to actively monitor and control the humidity measurements. During use, the unit can then be set, for example, 2 degrees lower to start the dehumidifying function. The user interface can include a sleep timer function where the user can set the amount of time the unit needs to run. When the run time is up, the unit shuts itself off safely; avoiding depletion of the battery. Furthermore, the display screen 302 is used to communicate icons of error messages to the user that the controller 204 may be encountering. These error messages include but not limited to:

- compressor overheating
- compressor controller loss/wiring problems
- compressor short-circuit
- evaporator de-ice function
- seawater pump not working
- condenser temperature overheat (indicative of not enough water circulating)
- low refrigerant
- controller overheat
- relay board overheat
- low/excessive voltage According to the present disclosure, the marine air conditioning system cools and dehumidifies a boat. In general, marine air conditioners operate differently than regular air conditioners because they use seawater as the medium for heat exchange rather than air to cool their systems. The abundance of available water and the efficiency in using the water make the implementation of this type of system preferable to traditional air conditioner systems. The principle behind marine air conditioners is the movement of heat similar to that of a heat pump. Technically, marine air conditioners do not really produce cold air, they instead remove heat from the air. When in use, the air conditioning unit 100 pulls heat from the air by transferring the heat in the cabin to the refrigerant gas within the air conditioner, then into the body of water. To achieve this, the compressor 120 pressures the refrigerant gas and pushes it into the condenser 110. The refrigerant gas moves inside the condenser around the water and exits the condenser 110. The refrigerant then enters and travels through the evaporator 108. In the meantime, ambient air is pulled from the cabin of the boat by suction created from the blower fan 118. The air is then pulled through the coils of the evaporator 108 and then into the blower fan assembly 118. As the phase-converting refrigerant expands and passes through the coils of the evaporator 108, the evaporator gets colder and the refrigerant turns into a gaseous state as it continues to absorb heat from the evaporator. In other words, the unit's blower fan 118 circulates the warm air from the cabin across the cold evaporator 108 and discharges it, now cooler, through discharge ducting back into the cabin. After passing through the evaporator 108, the refrigerant is sent back to the compressor 102. As shown in FIG. 2, a water pump 126 circulates seawater into the condenser 110 to absorb all of the heat from the refrigerant and then the seawater is released back into the body of water which the boat or vessel is in. Components of the air conditioner unit 100 are connected by inlet and outlet piping that reduces corrosion against salt water as the seawater enters, passes through, and exits from the condenser 110. To circulate the seawater through the condenser 110, the water pump 126 pumps water to the air conditioner unit 100 through an inlet pipe 128 into the condenser 110 to provide a path for the water to enter the condenser 110. An outlet pipe 130 provides a path for the water to exit the condenser 110 which then gets discharged back into the body of water.

Figure 6:
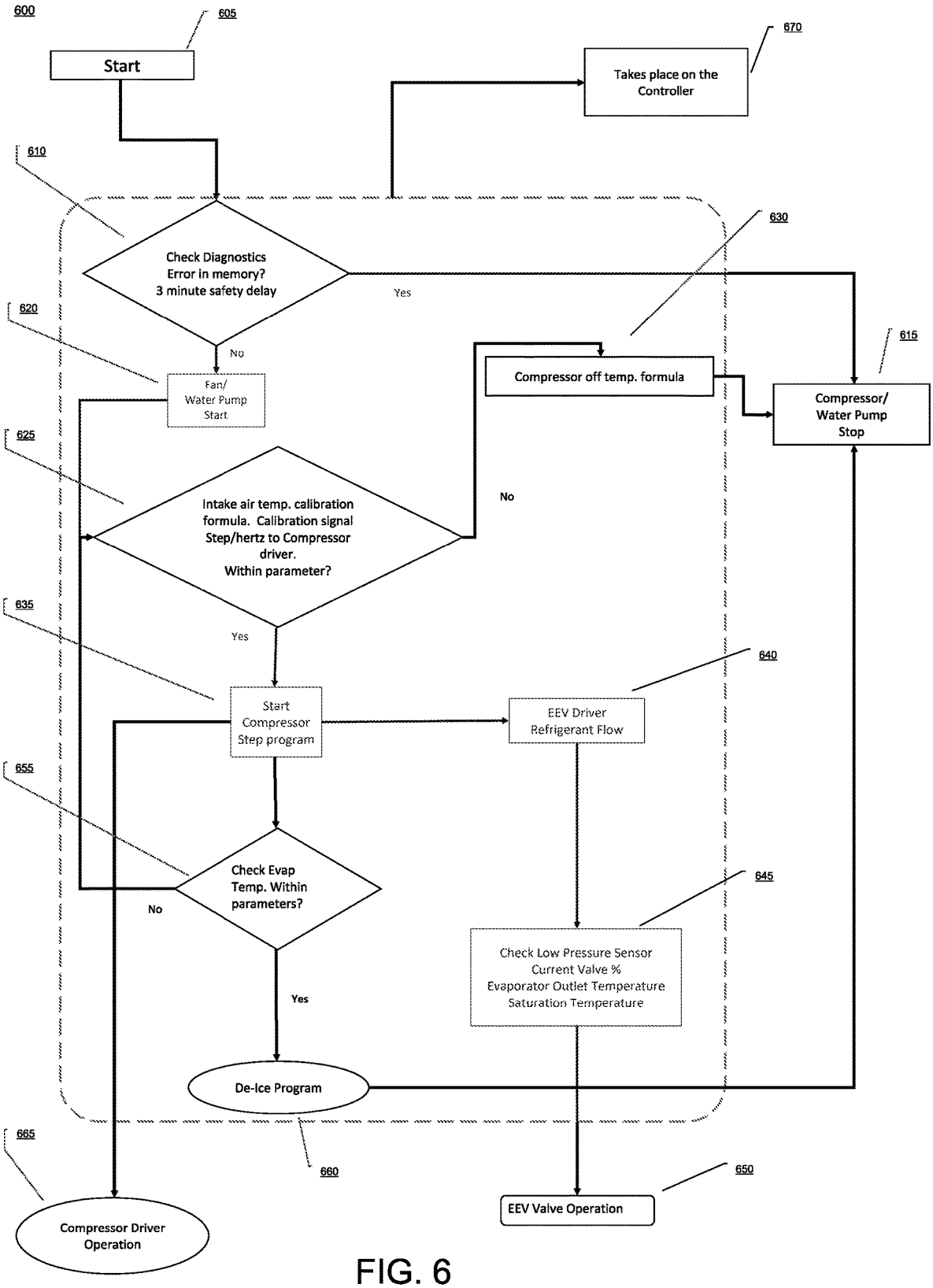
FIG. 6 is a flowchart of an exemplary process for monitoring and controlling an exemplary self-contained marine air conditioner unit in accordance with one or more embodiments of the disclosure.

FIG. 6 is a flowchart of an exemplary process 600 for monitoring and controlling the marine air conditioner unit 100. During operation, the controller 204 constantly controls and collects data from the compressor driver and the EEV driver and based on the various temperature and data conditions, the process 600 can calculate hundreds of combinations and/or permutations for valve adjustments within fractions of a second or milliseconds. As a result, the process 600 is able to maintain the precise control of the volume of refrigerant in the evaporator. These rapid calculations and continuous monitoring results in a significantly less energy consumption. By employing these valve adjustments, a cumulative system power reduction of 33% was estimated to have been achieved. The applicant is not aware of any manufacturer in the marine air conditioner industry that uses an electronic expansion valve in the manner described according to the present disclosure.

During operation as shown in the exemplary process 600, in step 605, the process starts. In step 610, the process performs a diagnostic check on the system. If a diagnostic error is detected in step 610, the process stops the compressor/water pump in step 615. If no diagnostic error is detected in step 610, the process starts the fan/water pump in step 620. In step 625, the process calculates a temperature difference between the intake air temperature and the compressor off temperature based on a predetermined threshold. The predetermined thresholds are calculated based on the calculations and permutations derived by the algorithm used by the controller. If the temperature difference does not exceed a predetermined threshold in step 625, the process adjusts the compressor off temperature variance in step 630. The process stops the compressor and the water pump. If the temperature difference does exceed the predetermined threshold in step 625, the process uses the algorithm to calculate the compressor speed in step 635. Then, the compressor speed is communicated to the compressor driver in step 665. Simultaneously, in step 640, the process retrieves data from the EEV driver to calculate the optimized amount of refrigerant flow. In step 645, the process monitors and checks various sensors and operating parameters, such as low pressure sensor, current valve opening %, evaporator outlet temperature, and saturation temperature and collects these data point to determine a new EEV open ratio %, which is the new adjustment value for the valve opening. In step 650, the process communicates to EEV driver to begin the valve operation based on the newly calculated EEV open ratio %. The valve opening adjustment calculation is a rapid and continuous process. During operation, the process can calculate hundreds of values representing the new valve opening adjustments within a matter of seconds. The process constantly instructs the valve to adjust the opening based on each new valve opening calculation. Thus, the EEV can be instructed by the controller to perform hundreds of adjustments within seconds. In step 655, the process checks the evaporation temperature. If the evaporation temperature does not meet a predetermined threshold in step 655, the process returns to step 625. If the evaporation temperature does meet the predetermined threshold in step 655, the process activates the de-ice program in step 660 and stops the compressor and/or water pump returning to step 615 In step 665, the process sends the compressor speed signal and receives operational data from the compressor driver. In step 670, all data analysis performed by the algorithm can take place on the controller. The data processed by the algorithm to perform the desired calculations can include, for example, program data, sub-program data, tabular data, real-time sensor data, and/or historical data. The term "program data" includes software; an application program; and other data associated with software application programs.

Embodiments of the present disclosure have numerous technical and commercial advantages. The present disclosure addresses the problem of 110V/220V marine air conditioners which are capable of running when a boat is docked but unusable when at anchor without running a large fuel-based generator. By taking advantage of modern variable speed compressors so the average current draw is less than half of comparable typical 29 A to 40 A equivalent draws, this unit allows extended use by boats' existing battery banks. The unit is designed specifically to be used overnight at anchor without the need to use a generator, an inverter, or other AC (alternating current) generating devices. It is extremely quiet in comparison to commercially available loud window units, and avoids the noise of a generator.

One of the technical advantages of the system and method of the present disclosure is increased energy efficiency—it is possible to run the present air conditioner with only a few solar panels and a modest battery bank. No generators, no inverters are needed. A commercial advantage is that there are over 10 million units of existing boats that are below the 40 ft size in which the present air conditioner can be easily installed. Most of these vessels do not have the room to carry or store generator sets. The unique combination of the type of the compressor 102, the data collected by the controller 204 from multiple points, and the electronic expansion valve 106 makes this device a very efficient product.

Another technical advantage is that the unit can further be converted into a geothermal system circulation of ground water with a pump. The air conditioner unit 100 can further be built similar to a window unit as a cabin/RV or as a dwelling air conditioner. Therefore, in some embodiments, the air conditioner unit 100 of the present disclosure can be used in locations such as disaster (hurricane, fires) prone areas for cooling with solar panels when utility power is not available.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A marine air conditioning unit, comprising:

a base plate having one or more mounting holes;

a main unit supported on the base plate comprising an evaporator, a compressor, a compressor driver, a condenser, an electronic expansion valve, a blower, a plurality of temperature and pressure sensors, and a condensation pan operatively coupled together;

the blower configured for drawing indoor air from a room of a boat through the evaporator;

the compressor located on a refrigerant line connecting the condenser to the evaporator to compress refrigerant flowing therethrough;

the electronic expansion valve located on the refrigerant line configured to operate as a flow regulator to create a pressure difference between the condenser and the evaporator;

a water pump fluidly connected to the condenser and configured for circulating water into the condenser to absorb heat from the refrigerant, wherein the water pump circulates the water from a body of water in which the boat is floating; and a controller configured to constantly receive, respond to, and, using an algorithm, analyze sensor information from multiple sensors including the plurality of temperature and pressure sensors positioned within the main unit, based on the sensor information the controller determines a precise amount of refrigerant to pass to the evaporator, and the controller transmits a control signal to adjust the electronic expansion valve to control the precise amount of refrigerant to pass to the evaporator;

wherein the controller is further configured:

to constantly control and collect data from the compressor driver and an electronic expansion valve driver; and using the algorithm, to calculate hundreds of valve adjustments combinations or permutations within fractions of a second to adjust the electronic expansion valve to maintain precise control of the precise amount of refrigerant in the evaporator.

2. The marine air conditioning unit of claim 1, wherein the controller is further configured to cool and dehumidify the air in the room by monitoring and controlling a humidity level within the room.

3. The marine air conditioning unit of claim 1, wherein the compressor is a variable speed brushless direct current (BLDC) compressor.

4. The marine air conditioning unit of claim 1, wherein the main unit is a self-contained unit such that all components are integrated and attached to the main unit.

5. The marine air conditioning unit of claim 1, wherein the marine air conditioning unit is configured for use in saltwater environments.

6. The marine air conditioning unit of claim 1, wherein the marine air conditioning unit is configured for use without the need to use a generator, an inverter, or AC (alternating current) generating devices while the boat is at anchor overnight.

7. The marine air conditioning unit of claim 1, wherein the electronic expansion valve includes a valve opening that is programmable and adjustable based on increments.

8. The marine air conditioning unit of claim 1, wherein the electronic expansion valve comprises a fully adjustable programmable valve opening.

9. The marine air conditioning unit of claim 1, wherein the controller is further configured for synchronizing the electronic expansion valve to the compressor to reduce a power draw of the compressor.

10. The marine air conditioning unit of claim 1, wherein the compressor is configured to operate at various compressor speeds; and the controller is further configured for synchronizing the compressor speed to a refrigerant flow rate corresponding to a flow of the refrigerant through the refrigerant line.

11. The marine air conditioning unit of claim 1, wherein the condensation pan comprises a sloping condensation pan with a drain to empty the condensation pan of condensation.

12. The marine air conditioning unit of claim 1, wherein the refrigerant line includes a refrigerant filter and an electrical pressure sensor.

13. The marine air conditioning unit of claim 1, further comprising a control box having a housing configured to house the controller, a control board, a relay board, and an electronic expansion valve driver.

14. The marine air conditioning unit of claim 13, wherein the control box is configured for having multiple mounting configurations such that the control box is attachable to the main unit and detachable from the main unit.

15. The marine air conditioning unit of claim 1, further comprising a user interface unit for communication with the controller to enable user control of the marine air conditioning unit and provide feedback to the user and the user interface unit configured to receive user input data from a user interaction with a user interface screen;

wherein the user interface unit comprises:

one or more user interface unit sensors configured to acquire sensor data indicative of at least one of a temperature and humidity level within the room;

a memory configured to store the sensor data and the user input data; and a communication interface configured to communicate with a processor:

transmit the sensor data and the user input data from the memory to the processor for analysis to implement operations of the marine air conditioning unit; and receive based on the analysis from the processor the feedback to the user for display on the user interface screen.

16. The marine air conditioning unit of claim 15, wherein the user interface unit includes a humidity sensor and a sleep timer function.

17. A method for controlling a marine air conditioning unit, comprising:

the marine air conditioning unit including:

a base plate having one or more mounting holes;

a main unit supported on the base plate comprising an evaporator, a compressor, a compressor driver, a condenser, an electronic expansion valve, a blower, a plurality of temperature and pressure sensors, and a condensation pan operatively coupled together;

the blower configured for drawing indoor air from a room of a boat through the evaporator;

the compressor located on a refrigerant line connecting the condenser to the evaporator to compress refrigerant flowing therethrough;

the electronic expansion valve located on the refrigerant line configured to operate as a flow regulator to create a pressure difference between the condenser and the evaporator;

a water pump fluidly connected to the condenser and configured for circulating water into the condenser to absorb heat from the refrigerant, wherein the water pump circulates the water from a body of water in which the boat is floating; and a controller configured to constantly receive, respond to, and, using an algorithm, analyze sensor information from multiple sensors including the plurality of temperature and pressure sensors positioned within the main unit, based on the sensor information the controller determines a precise amount of refrigerant to pass to the evaporator, and the controller transmits a control signal to adjust the electronic expansion valve to control the precise amount of refrigerant to pass to the evaporator;

the method for controlling the marine air conditioning unit comprising:

performing an initial diagnostic safety check;

detecting an intake air temperature of the air;

detecting a compressor off temperature of the compressor;

determining whether a difference between the intake air temperature and the compressor off temperature meet a first threshold value;

adjusting the compressor off temperature when the difference does not exceed the first threshold value;

operating the compressor when the difference exceeds the first threshold value;

operating the electronic expansion valve based on the control signal to adjust the electronic expansion valve; and continuously monitoring and obtaining, by the controller, data including:

a low pressure measurement from a low pressure sensor located on a low pressure portion of the refrigerant line;

a valve open ratio from the electronic expansion valve;

an evaporator outlet temperature;

compressor driver data; and electronic expansion valve driver data.

18. The method of claim 17, further comprising:

detecting an evaporation temperature and determining whether the evaporation temperature meets a second threshold value; and activating a de-ice function when the evaporation temperature exceeds the second threshold value.

* * * * *